United States Patent [19]

Rosenbaum

[11] Patent Number: 4,925,066

[45] Date of Patent: May 15, 1990

[54] COMBINED SPRAYER AND REFILL CONTAINER

[75] Inventor: Robert S. Rosenbaum, Los Angeles, Calif.

[73] Assignee: Mission Kleensweep Products, Inc., Los Angeles, Calif.

[21] Appl. No.: 262,602

[22] Filed: Oct. 26, 1988

[51] Int. Cl.[5] ..... B67D 5/60

[52] U.S. Cl. ..... 222/192; 215/10; 222/130; 222/143; 222/158; 222/192; 222/383; 220/23.4

[58] Field of Search ..... 222/129, 130, 143, 157, 222/156, 158, 383, 192; 220/23.2, 23.4, 23.8, 23.83, 23.86; 215/6, 10; 239/333, 352; 206/568; 732/426–428

[56] References Cited

U.S. PATENT DOCUMENTS

| | | | |
|---|---|---|---|
| 2,640,628 | 6/1953 | Klosky | 222/158 |
| 3,181,737 | 5/1965 | Chaucer | 222/143 X |
| 3,199,739 | 8/1965 | Corning et al. | 222/130 |
| 3,225,951 | 12/1965 | Poston et al. | 215/10 X |
| 3,295,710 | 1/1967 | Marchant | 220/23.8 |
| 3,655,096 | 4/1972 | Easter | 215/6 X |
| 3,658,204 | 4/1972 | Bottger | 215/6 X |
| 4,125,207 | 11/1978 | Ernst et al. | 222/130 |
| 4,355,739 | 10/1982 | Vierkötter | 222/383 X |
| 4,705,191 | 11/1987 | Itzel et al. | 222/383 X |
| 4,713,064 | 12/1987 | Bruno et al. | 215/10 X |

FOREIGN PATENT DOCUMENTS

| | | | |
|---|---|---|---|
| 1125216 | 8/1968 | United Kingdom | 220/23.83 |

*Primary Examiner*—Kevin P. Shaver
*Attorney, Agent, or Firm*—Charles H. Schwartz; Ellsworth R. Roston

[57] ABSTRACT

A combined sprayer container and refill container for containing a liquid concentrate for later dilution and which containers nest and interlock. A sprayer container including a sprayer head for spraying liquid contained in the sprayer container. The sprayer container also including at least one level indicia foro indicating a level to be filled to with the liquid concentrate for dilution. A refill container for containing a liquid concentrate for use in repeated refilling of the sprayer container. The sprayer container and refill container each including complementary surfaces to provide nesting of the containers one against the other. An interlock provided on both the sprayer container and refill container for interlocking the nested containers to resist separation of the nested containers.

13 Claims, 2 Drawing Sheets

COMBINED SPRAYER AND REFILL CONTAINER

BACKGROUND OF THE INVENTION

1. Field of the Invention

The present invention relates to a combined sprayer container and refill container. Specifically, the invention relates to a sprayer container and refill container which nest together and are interlocked so as to secure the two containers to each other. The invention is especially suitable for use for a highly concentrated liquid cleaner which is contained in the refill container and with the sprayer container periodically filled with a small portion of the concentrated cleaner and then diluted with water.

2. Description of the Prior Art

Liquid cleaners, such as all purpose liquid cleaners generally are sold in a diluted form. The consumer buys the cleaner in the diluted form and uses it directly from the bottle either by applying with a cloth, or with a sprayer. In some instances, the cleaner may be further diluted by pouring the cleaner into a separate container and then diluting the liquid cleaner with water.

It is also possible to buy liquid cleaners in a more concentrated form. In these situations, the cleaner can be used at full strength or can be poured into a separate container (pail or bucket) and diluted with water for use as an all purpose cleaner. In the prior art examples described above, the cleaner is supplied as is or separate sprayer container may be supplied by the manufacturer of the cleaner or may be separately purchased.

In the prior art, the sprayer container is not formed as part of a combined structure so that a total package can be presented to the consumer. It would, therefore, be desirable to be able to present to the consumer a combined package which is formed of two nested containers which are interlocked and with one container including a concentrated liquid, such as liquid cleaner, and with the other container formed as a sprayer container. The concentrated liquid may then be poured into the sprayer container and then diluted with water so that the sprayer can be used as a separate item. When not in use, the two containers should nest and interlock so that they may be stored as a unit.

SUMMARY OF THE INVENTION

The present invention, therefore, comprises at least a pair of containers which nest and interlock with each other and with one container formed as a refill container and the other container formed as a sprayer container. The refill container is filled with a concentrated liquid, such as a liquid cleaner, and with the sprayer container including at least one indicia to indicate at least one level to be filled with the concentrate. The remaining portion of the sprayer container may then be filled with water to dilute the concentrate and the sprayer can then be used separately for cleaning.

The specific nesting and interlocking of the two containers is provided by an upstanding upper portion of the refill container which is received within a recess portion forming part of the sprayer head for the sprayer container. The lower end of the refill container includes a step portion which is frictionally received within a slot in the sprayer container.

In order to assist in the nesting and interlocking of two containers, the refill container may have one wall formed with a concave portion in which the step member is located and with the sprayer container including one wall formed with a complementary convex portion including the slot. The use of the concave and convex portions provides for a sufficient surface contact between the two containers in combination with the interlocking members so that the two containers will nest easily, but cannot be accidentally dislodged. When, however, it is desired to separate the containers, the containers may be pulled apart to disengage the frictional surfaces to thereby separate the two containers. At this time the refill container may be used to supply concentrated liquid into the sprayer container for dilution and once the concentrated liquid in the sprayer container has been properly diluted, the sprayer container can then be used to spray the liquid onto a surface to be cleaned.

The combined structure, therefore, provides for the refill container containing enough concentrate so that the sprayer may be refilled a number of times. In this way, it is not necessary to store a very large container with already diluted liquid cleaner as now necessary if it is desired to buy a large quantity of typical all purpose cleaners now sold. On the other hand, the combined structure of the refill container and sprayer of the present invention is not such larger then the existing spray bottles of all purpose liquid cleaners now currently sold. The present invention, therefore, provides for a much more efficient use of the storage space either for the store which stocks and sells the all purpose cleaner, or the consumer after purchase.

The combined structure of the present invention, therefore, is more cost effective since the store and consumer does not have to purchase, transport and store already diluted liquid cleaner where the dilution is provided by water. The saving of space and weight also reduces shipping costs to the store and allows the store to sell the present invention at a better price compared with the prior art diluted liquid cleaners.

A clearer understanding of the present invention will be had with reference to the following description and drawings.

DETAILED DESCRIPTION OF THE INVENTION

Figure 1:
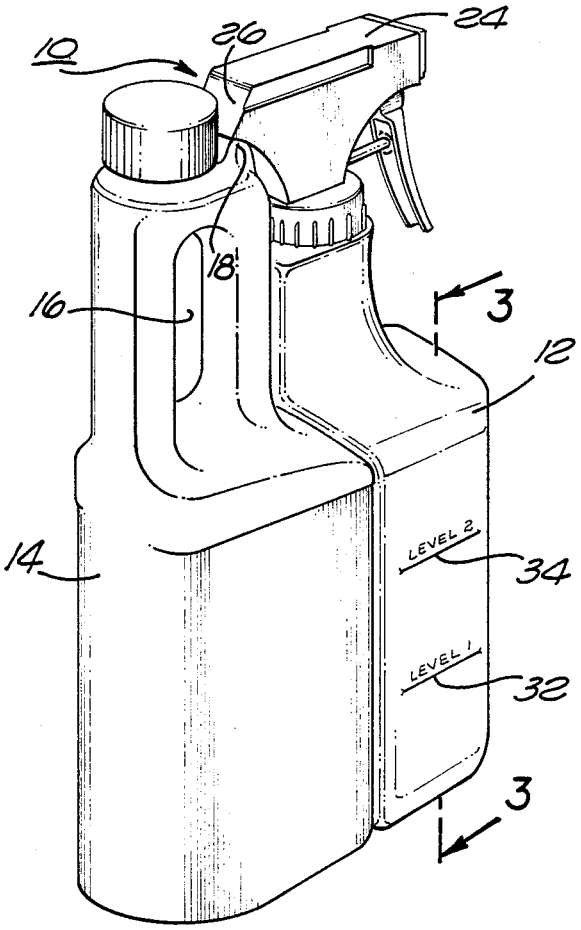
FIG. 1 is a front perspective view of the combined sprayer container and refill container of the present invention.
Figure 2:
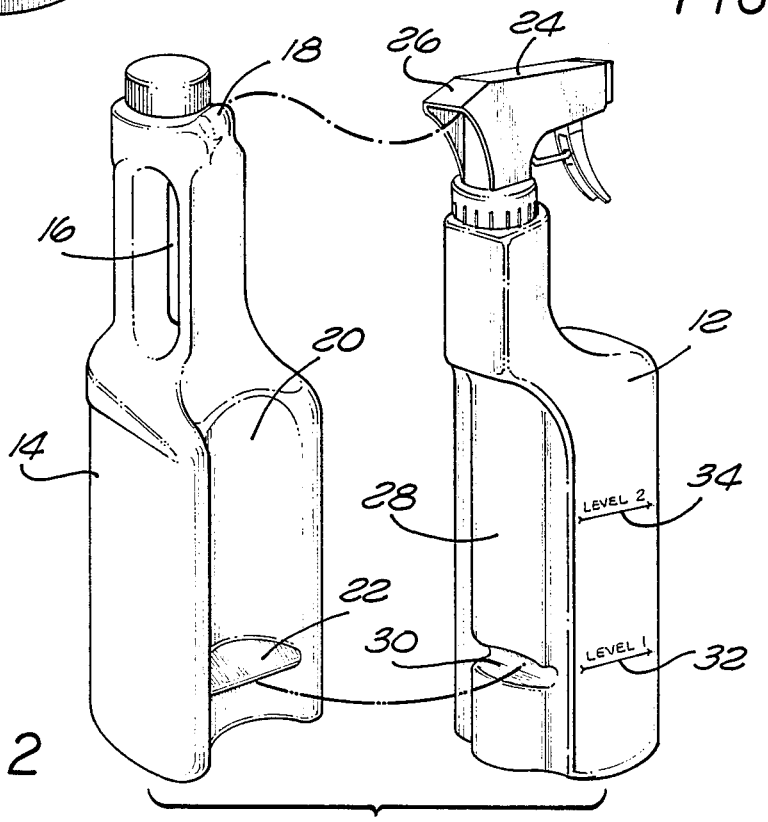
FIG. 2 illustrates the combined structure split apart into the two component portions of the sprayer container and refill container.

As shown in the different FIGS. 1 through 4, the combined structure 10 includes a sprayer container 12 and a refill container 14. As can be seen in FIG. 1, the sprayer container 12 and the refill container 14 are nested and interlocked to form the combined structure 10 which is self standing and self supporting. The combined structure 10 may, therefore, be stored and carried as a single structure to provide for the advantages described above. Alternatively, the two containers may be separated as shown in FIG. 2, so that each container may be used separately to provide for specific purposes.

Figure 4:
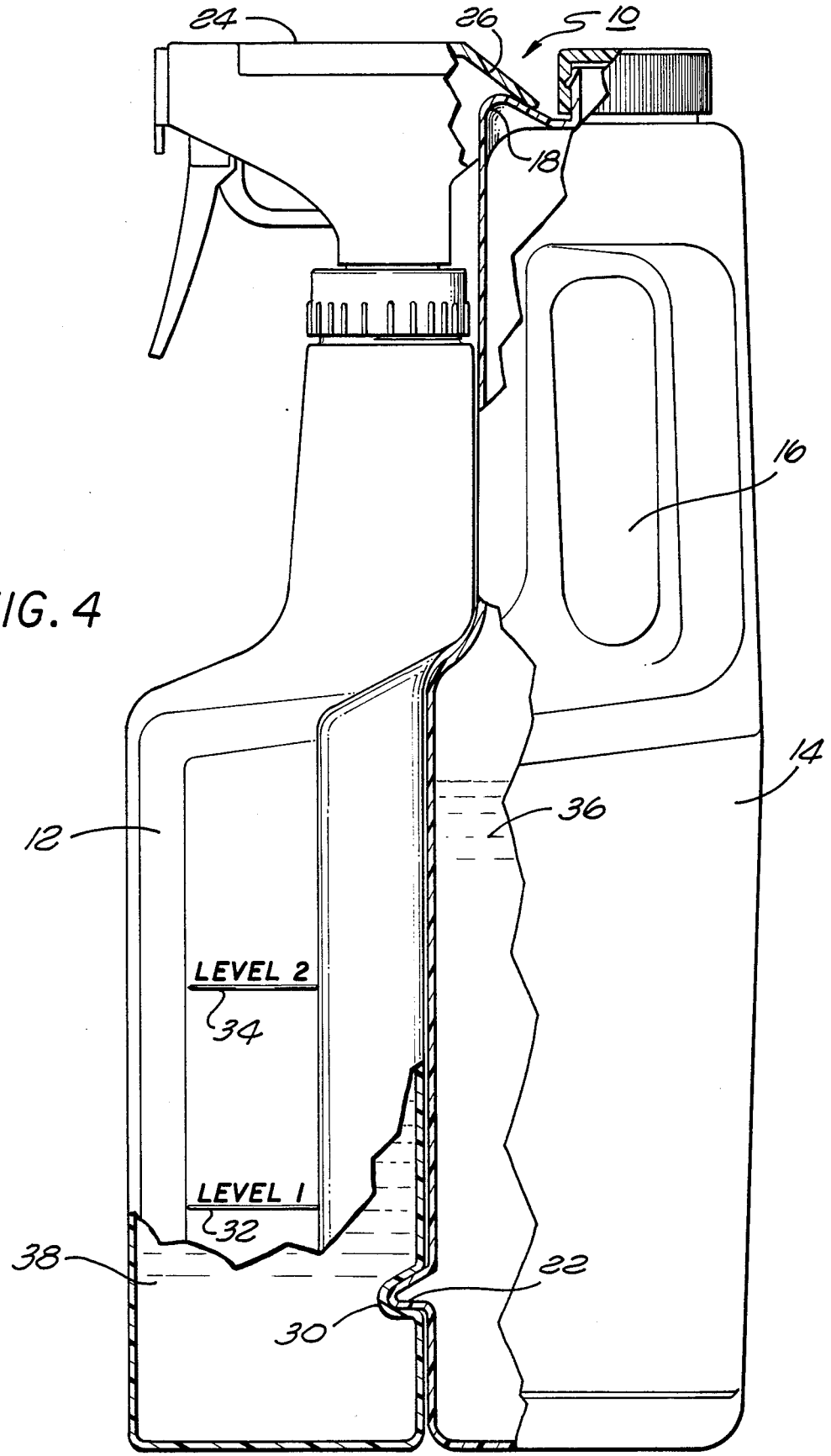
FIG. 4 is an enlarged side view partially broken away illustrating the interlocking provided at the top and bottom of the combined structure.

The refill container 14 has a particular shape to provide for the desired characteristics of the present invention. Specifically, the refill container includes an opening 16 so that the refill container may be grasped to carry or pour from the refill container when the refill container is used as a separate item. In addition, when the refill container 14 and the sprayer container 12 are nested and interlocked as shown in FIGS. 1 and 4, the opening 16 provides a convenient handle to carry the combined structure.

The refill container 14 also includes an upwardly extending portion 18 which is used for interlocking with the sprayer container. The refill container 14 also includes a concave portion 20 formed along one side of the refill container and with a step member 22 formed within the concave portion 20. Both the concave portion 20 and the step member 22 are used to facilitate the nesting and interlocking with the sprayer container 12.

The sprayer container 12 includes a sprayer head 24 having a pump handle for actuating the pump to pull liquid from the spray container for spraying through the head 24. The head also has a forward portion 26 forming a downwardly extending ledge to provide a recess portion to receive the upwardly extending portion 18. Specifically, the underside of the downwardly extending ledge 26 may be positioned over the top of the upwardly extending protrusion portion 18, as shown in Figure 4, to provide for a first interlock at the upper end of the combined structure.

The sprayer container 12 also includes a convex portion 28 having a slot 30. The convex portion 28 of the sprayer container 12 has a complementary profile to the concave portion 20 of the refill container 14 so that the convex and concase portions may nest. Similarly, the slot 30 has a complementary profile to the step member 22. This forms a bottom frictional interlock for the combined structure as shown in FIG. 4.

The nesting of the convex and concave portions 28 and 20 prevents side to side sliding between the containers 12 and 14 when the containers are snapped together and interlocked using the upper interlock formed by the portion 14 and ledge 26 and the lower interlock formed by the step 22 and slot 30. The above described structure, therefore, provides for a nesting and interlocking of the two containers relative to each other so that the containers may be transported, stored and sold as a single unit.

When it is desired to separate the units, the two containers may be grasped and pulled apart at the bottom to release the step member 22 from the slot 30 at which time the portion 18 can slide out of the recess formed by the ledge 26. Similarly, to lock the containers together, the upward extending portion 18 may be slid under the ledge 26 into the recess and the step member 22 may then be snapped into the slot 30. The structure is provided with sufficient frictional engagement to maintain the containers in an interlocking relationship and with the concave portion 20 and convex portion 28 of the containers 14 and 12 insuring that the containers are nested so that they will not become easily dislodged.

Figure 3:
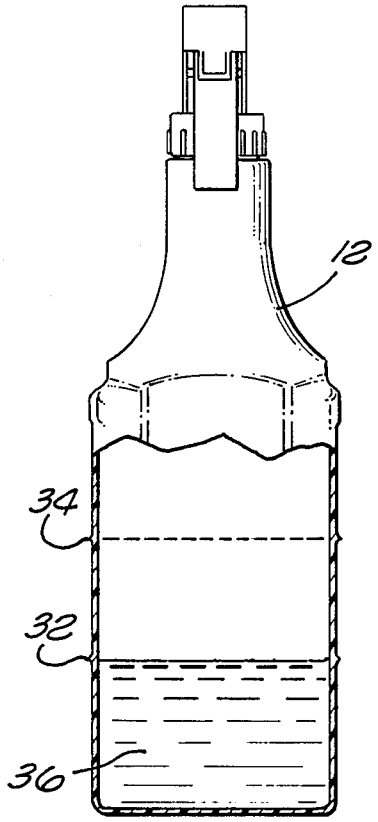
FIG. 3 is a cross sectional view of the combined structure taken along lines 3—3 of FIG. 1.

It may also be seen that the sprayer container 12 has at least one (1) and as shown in FIGS. 1, 2 and 4 two (2) different indicia levels 32 and 34. These levels are marked in the drawing as "LEVEL 1" and "LEVEL 2". As shown in FIG. 4, the refill container 14 may contain a concentrated liquid 36. The level of the liquid 36, as shown in FIG. 4, is below the top indicating that a portion of the concentrated liquid has been used. Specifically, as shown in FIG. 3, a portion of the concentrated liquid 36 may have been poured into the sprayer container 12 to the "LEVEL 1". The concentrated liquid may then be used in its concentrated form if desired, or additional dilutant such as water may be added to provide for a diluted liquid 38 as shown in FIG. 4.

In other words, the refill container 14 may contain sufficient concentrated liquid 36 so as to be used a number of times to refill the spray container 12 and with the concentrated liquid then diluted by a desired amount of diluant to provide for the all purpose cleaner. It should be noted that the concentrated liquid may either be used in a completely concentrated form for heavy duty cleaning, or the sprayer container 12 may be filled to "LEVEL 2" and with a particular amount of diluant, such as water, added to provide for a medium duty cleaner or the concentrated liquid poured into the sprayer container 12 to "LEVEL 1" and with a larger amount of diluant added to provide for a light duty cleaner. The use of a concentrated cleaner in combination with the sprayer container having different level indicia can provide for great flexibility in the type of cleaner used by the consumer to be heavy duty, medium duty, or light duty.

The present invention, therefore, provides for a combined refill container and sprayer container which may be transported, stored and sold as a single unit, and with the refill container filled with a concentrated liquid, and with the sprayer container being filled to particular levels represented by indicia on the side of the sprayer container from the refill container, and with the remaining volume of the sprayer container filled with a dilutant. The two containers may be used individually to provide for individual functions, but would be snapped together and interlocked using an upper and lower interlocking structure to provide for the unique combined structure. The present invention, therefore, provides for great flexibility in the sales and marketing of liquid concentrate and is cost effective in its use of space to present the combined product to the consumer.

It should be appreciated that although the invention has been described with reference to a particular embodiment, other adaptations and modifications may be remade. For example, when presenting the product for sale in a store environment a shrink pack may be provided around the combined structure to prevent the two containers from being separated in the store. When the consumer brings the product home, the shrink pack would be removed and the product would operate as shown and described in the present application. The invention, therefore, is only to be limited by the appended claims.

I claim:

1. A combined sprayer container and refill container for containing a liquid concentrate for later dilution and which containers nest and interlock, including a sprayer container including a sprayer head for spraying liquid contained in the sprayer container, the sprayer container also including at least one level indicia for indicating a level to be filled to with the liquid concentrate for dilution, a refill container for containing a liquid concentrate for use in repeated refilling of the sprayer container, the sprayer container and refill container each including complementary surfaces to provide nesting of the containers one against the other, and interlock means provided on both the sprayer container and refill container for interlocking the nested containers to resist separation of the nested containers.

2. The combined sprayer container and refill container of claim 1 wherein one of the sprayer container or refill container includes a handle portion to facilitate carrying of the combined structure.

3. The combined sprayer container and refill container of claim 2 wherein the handle portion is formed in the refill container to additionally facilitate the pouring of the liquid concentrate into the sprayer container from the refill container for dilution in the sprayer container.

4. The combined sprayer container and refill container of claim 1 wherein the sprayer container includes more than one level indicia for indicating more than one level to be filled to with the liquid concentrate for dilution to produce different concentrations after dilution.

5. The combined sprayer container and refill container of claim 1 wherein the complementary surfaces are formed by a concave surface in one of the sprayer container and the refill container and a convex surface in the other of the sprayer container and the refill container.

6. The combined sprayer container and refill container of claim 5 wherein the concave surface is formed in the refill container and the convex surface is formed in the sprayer container.

7. The combined sprayer container and refill container of claim 1 wherein the interlock means is provided at two spaced positions to provide spaced interlocking to resist separation of the nested containers.

8. The combined sprayer container and refill container of claim 7 wherein the two spaced positions are located at top and bottom positions for the combined structure to enhance the interlocking.

9. The combined sprayer container and refill container of claim 8 wherein the interlocking at the top position includes an overlapping of the refill container and the sprayer head of the sprayer container.

10. The combined sprayer container and refill container of claim 9 wherein the overlapping is provided between an upwardly extending portion of the refill container and a recess produced below a downwardly extending ledge portion of the sprayer head.

11. The combined sprayer container and refill container of claim 8 wherein the interlocking at the bottom position includes a step member extending outwardly and a slot extending inwardly to have the step member received in the slot to produce interlocking.

12. The combined sprayer container and refill container of claim 11 wherein the step member is formed in the refill container and the slot formed in the sprayer container.

13. The combined sprayer container and refill container of claim 12 wherein the complementary surfaces are formed by a concave surface in the refill container and a convex surface in the sprayer container and with the step member formed within the concave surface and with the slot formed within the convex surface.

* * * * *